United States Patent [19]

Malhotra et al.

[11] Patent Number: 4,822,674

[45] Date of Patent: Apr. 18, 1989

[54] INK DONOR FILMS

[75] Inventors: Shadi L. Malhotra, Mississauga; Maya D. Stevanovic, Weston, both of Canada

[73] Assignee: Xerox Corporation, Stamford, Conn.

[21] Appl. No.: 43,068

[22] Filed: Apr. 27, 1987

[51] Int. Cl.[4] ..... B41M 5/26

[52] U.S. Cl. ..... 428/336; 428/195; 428/207; 428/216; 428/337; 428/412; 428/419; 428/447; 428/480; 428/483; 428/484; 428/488.1; 428/488.4; 428/508; 428/511; 428/514; 428/515; 428/520; 428/913; 428/914

[58] Field of Search ..... 428/195, 447, 484, 488.1, 428/488.4, 913, 914, 207, 216, 336, 337, 412, 419, 480, 483, 508, 511, 514, 515, 520

[56] References Cited

U.S. PATENT DOCUMENTS

| | | | |
|---|---|---|---|
| 2,598,666 | 6/1952 | Sesso et al. | 106/10 |
| 3,086,873 | 4/1963 | Steinbrunner | 106/24 |
| 3,249,448 | 5/1966 | Coburn et al. | 106/31 |
| 3,594,209 | 7/1971 | Kosche et al. | 117/36.1 |
| 4,234,644 | 11/1980 | Blake et al. | 428/204 |
| 4,273,602 | 6/1981 | Kosaka et al. | 156/234 |
| 4,370,379 | 1/1983 | Kato et al. | 428/341 |
| 4,390,369 | 6/1983 | Merritt et al. | 106/31 |
| 4,476,179 | 10/1984 | Moriguchi et al. | 428/216 |
| 4,484,948 | 11/1984 | Merritt et al. | 106/31 |
| 4,490,430 | 12/1984 | Findlay et al. | 428/217 |
| 4,523,956 | 6/1985 | Thurlow | 106/243 |
| 4,678,687 | 7/1987 | Malhotra | 427/261 |

FOREIGN PATENT DOCUMENTS

| | | | |
|---|---|---|---|
| 135290 | 7/1985 | Japan | 428/488.4 |
| 1577 | 1/1987 | Japan | 428/913 |

*Primary Examiner*—Ellis P. Robinson
*Assistant Examiner*—P. R. Schwartz
*Attorney, Agent, or Firm*—E. O. Palazzo

[57] ABSTRACT

Disclosed is an ink donor film for thermal transfer printing processes comprised of a supporting substrate with a coating of an ink composition on the top surface thereof, which ink is comprised of a blend of four hydrocarbon waxes, pigment particles, pigment dispersants, and binder polymers selected from the group consisting of (1) styrene-b-isoprene-b-dimethyl siloxane triblock copolymers; (2) blends of styrene-b-isoprene diblock copolymers with styrene-b-dimethyl siloxane diblock copolymers; (3) styrene/ethylacrylate/butylacrylate random copolymers; and (4) poly(vinylmethyl ether).

26 Claims, No Drawings

INK DONOR FILMS

BACKGROUND OF THE INVENTION

This invention relates generally to thermal transfer printing, and more specifically, the present invention is directed to certain ink donor films useful, for example, in thermal transfer printing processes. In one specific embodiment of the present invention there is provided an ink donor film comprised of, for example, a supporting substrate, and thereover an ink containing a blend of waxes, pigment, or dye particles and certain polymers. Moreover, in accordance with another embodiment of the present invention there is envisioned a single strike ink donor film comprised of a supporting substrate, such as Mylar, and an ink containing a blend of four waxes, preferably hydrocarbon waxes, polymers such as poly(-vinylmethyl ether), pigment particles and a pigment dispersant. Moreover, in accordance with another embodiment of the present invention there can be selected a multistrike ink donor film comprised of a blend of four waxes, certain polymers such as styrene-b-isoprene-b-dimethylsiloxane triblock copolymer, and oil soluble dyes or pigment particles with a dispersant. With the aforementioned ink donor films there results, subsequent to transfer, images of excellent resolution with no background deposits thereon, and wherein the ink selected exhibits low viscosity, acceptable thermal stability, and superior adhesion to the donor substrate.

In thermal transfer printing, there is selected an ink donor film consisting of a thin substrate coated with a waxy ink. In operation, the inked portion of the donor film is placed in contact with a plain paper receiver sheet, a smooth calendered paper, or a Mylar sheet followed by directing heat from a thermal printhead to the back of the ink donor film substrate causing ink to melt and wet the receiver sheet. Subsequent separation of the sheets provides for the transfer of ink to the image areas of the plain paper. Various substrates are of interest for the ink donor film including highly calendered condenser papers with thicknesses of from about 10 to about 20 microns and polyester (Mylar) films. Thermal printers utilizing such materials are selected for a variety of applications including facsimile, printer plotters, and computer output printers. Also, as office automation increases, low cost thermal printers appear to be prime candidates for communicating terminals allowing for office quality hard copy inputs. The main advantages of these printers are reliability, compactness, speed and low cost.

Generally, thermal printers can be classified as direct and transfer. In the direct system, a paper having a thermally sensitive coating, either a wax or an organic metal compound, is selectively heated causing color changes in the coating. In the transfer type of printer, a donor ribbon loaded with a marking material, typically a heat sensitive ink, is transported to a thermal printhead and a plain paper recording sheet. The printhead is electrically activated to selectively apply heat to the donor sheet thereby causing the melting and the transfer of a portion of the marking material onto paper in image configuration.

Disclosed in U.S. Pat. No. 4,273,602 are heat sensitive recording materials comprised of a support sheet of a thickness of from 5 to 40 microns having thereon a heat sensitive transfer layer with a phenolic material, a colorless or precolored material which reacts with the phenolic material to form color upon application of heat, and a heat fusible material having a melting point of 40° C. to 150° C. with an image receiving sheet superimposed on the surface of this layer. It is indicated in this patent that heat sensitive transfer layers can be formed from waxes or resins of low molecular weight with colored dyes dispersed therein, however, apparently there are problems associated with such a method in that part of the layer transfers to ordinary paper causing undesirable staining and a decrease in contrast between letters and the background. Accordingly, the recorded letters cannot be easily read.

Also, there is disclosed in U.S. Pat. No. 4,476,179 an ink donor sheet comprising a porous sheet and a heat-fusible ink layer formed thereover. The ink layer selected has a temperature-dependent gradation characteristic that enables it to remain solid at ordinary temperatures, and further when it is heated to a certain temperature its viscosity is suddenly decreased, and upon further heating, the viscosity is decreased gradually. The aforementioned ink donor sheet is capable of producing halftones on the images it creates.

There are described in application U.S. Ser. No. 666,702 relating to thermal transfer printing sheets, the disclosure of which is totally incorporated herein by reference, thermal transfer imaging sheets containing certain coating compositions thereof. More specifically, there are illustrated in this application transparencies suitable for the effective transfer of developed images from a donor sheet comprised of a transparent substrate, and a coating thereto selected from poly(vinylethers), poly(acrylic acid esters), and poly(methacrylic acid esters).

Additionally, the preparation of transparencies by electrostatic means is known. There is thus disclosed, for example, in U.S. Pat. No. 4,370,379 a method for preparing an original for projection according to electrophotographic processes. More specifically, it is indicated in this patent that the conventional method for preparing a projection original for an overhead projector, (a transparent sheet) according to electrostatic photography, comprises transferring a toner image formed on a photosensitive plate onto a stretched polyester film, and fixing the transferred toner image on the film by heat. Various plastic films can be used for this purpose including a biaxially stretched polyester film. It is further indicated in this patent that the transfer film selected for electrostatic photography is comprised of a film substrate which is transparent, such as a biaxially stretched polyethylene terephthalate film including Mylar films.

Moreover, there is disclosed in U.S. Pat. No. 4,234,644 a composite lamination film for electrophoretic toner images deposited on a plastic dielectric receptor sheet comprising in combination an optically transparent flexible support layer, an optically transparent flexible intermediate layer of a heat softenable film applied to one side of the support layer, and wherein the intermediate layer possesses good adhesion to the support layer. It is indicated in this patent that the support layer can be prepared from various suitable substances including polycarbonates, polysulfones, polyethylene terephthalates, Mylars, and the like.

In addition, it is known that thermal transfer printing utilizes single strike ink donor films, however, about 90 percent of the film is discarded rendering the selected process uneconomical. To alleviate this disadvantage, efforts have been devoted to the development of multistrike ink donor films wherein the film is reusable, that is for example wherein the ink donor film releases a controlled amount of ink which is transferred onto a receiver sheet. This objective is achievable with the invention of the present application. Accordingly, there is a need for ink donor films with waxes thereon that are substantially permanently adhered to the film component. Moreover, there is a need for ink donor films useful for the transfer of images to appropriate substrates, and wherein the images are of excellent resolution and retain their image density for extended time periods. Furthermore, there is a need for economical ink donor films useful in thermal transfer printing processes, and wherein the films comprise specific copolymers containing therein waxes and pigment components. There is a further need for multistrike processes wherein the ink donor film selected can be reused for in excess of about 7 image formulations and transfer processes. Also, there remains a need for ink donor films wherein acceptable images on transparencies are achievable. Furthermore, there continues to be a need for ink formulations present in ink donor films, which films are useful as single strike or multistrike components in, for example, thermal transfer printing apparatuses.

SUMMARY OF THE INVENTION

It is an object of the present invention to provide improved ink donor films.

Another object of the present invention resides in the provision of certain ink compositions present on supporting substrates, and wherein the resulting film can be selected for thermal transfer printing processes.

In yet another object of the present invention there are provided adhesive ink formulations enabling the resulting ink donor films to be selected for an extended number of printing cycles, and wherein substantially the entire film is utilized and a major portion thereof is not discarded as is the situation with many prior art thermal transfer printing ink donor films.

In still a further object of the present invention there are provided ink donor films comprised of a supporting substrate, and thereover ink formulations containing a blend of waxes, pigment particles, and polymer components.

Additionally, in a further object of the present invention there are provided ink donor films that enable the thermal transfer of images to supporting substrates, and wherein the images are of excellent resolution with no background deposits thereon.

Furthermore, in another object of the present invention there are provided ink formulations for ink donor films, which formulations contain therein as an important component certain copolymer materials.

In still yet another object of the present invention there are provided ink donor films containing ink formulations comprised of a blend of waxes and pigment particles, and wherein the polymer component is a homopolymer compatible with the blend of waxes selected, which formulations are particularly useful in single strike printing processes.

Furthermore, in yet another object of the present invention there are provided ink donor films wherein there can be obtained up to four solid area prints and an excess of seven line copy prints primarily as a result of the strong adhesion of the ink polymer component to the supporting substrate thereby enabling cohesive film splitting to occur.

Another object of the present invention resides in ink donor films wherein the ink formulation selected is not completely released to the substrate brought in contact therewith, and wherein there results images with smudgeproof characteristics, an advantage not achievable in many instances with ink jet printing processes.

These and other objects of the present invention are accomplished by the provision of ink donor films containing an adhesive ink formulation with waxes therein. More specifically, in accordance with one embodiment of the present invention there are provided ink donor films comprised of a supporting substrate, and thereover an ink formulation comprised of a blend of waxes, pigment, or dye, particles, and polymer components, especially copolymers.

There is thus provided in a specific aspect of the present invention an ink donor film comprised of a supporting substrate with an optional coating of, for example, poly(vinyl alcohol) or aluminum on the bottom surface thereof, and in contact therewith an ink formulation comprised of a blend, in various effective amounts, of waxes; particles selected from the group consisting of pigments with dispersants, and oil soluble dyes; and polymers selected from the group consisting of (1) styrene-b-isoprene-b-dimethylsiloxane triblock copolymers, (2) blends of styrene-b-isoprene and styrene-b-dimethylsiloxane diblock copolymers, (3) styrene/ethylacrylate/butylacrylate random copolymers, and (4) poly(vinyl methylether).

In one specific embodiment of the present invention, the ink formulation, which is a one-phase system wherein the thermal ink and the binder polymer forms a homogeneous entity, is comprised of from about 92 percent by weight to about 73 percent by weight of a blend of four waxes; from about 1 percent by weight to about 12 percent by weight of pigment particles; from about 4 percent by weight to about 5 percent by weight of a pigment dispersant, and as a polymer component from about 3 percent by weight to about 10 percent by weight of poly(vinyl methylether).

Another specific embodiment of the present invention resides in the selection of an ink formulation comprised of from about 92 percent by weight to about 53 percent by weight of a blend of four waxes; from about 1 percent by weight to about 12 percent by weight of oil soluble dyes or pigment particles; from about 4 percent by weight to about 5 percent by weight of a pigment, or dye dispersant; and as a polymer component (1) from about 10 percent by weight to about 30 percent by weight of a styrene-b-isoprene-b-dimethylsiloxane triblock copolymer; (2) from about 10 percent by weight to about 30 percent by weight of a styrene/ethylacrylate/butylacrylate random copolymer; and (3) from about 10 percent by weight to about 30 percent by weight of a blend of the two diblock copolymers styrene-b-isoprene and styrene-b-dimethylsiloxane, comprised of 50 percent by weight styrene-b-isoprene and 50 percent by weight of styrene-b-dimethylsiloxane. This specific embodiment of the present invention envisions that the blend of waxes, oil soluble dyes or pigments, and copolymers form a two phase system where poly(styrene) is one phase and the low melt polymers, wax blends and dyes or pigments constitute the second phase. Ink donor films prepared with these two phase systems yield multiple prints since during the printing process, the molten second phase encounters resistance from the solid phase one in transferring on paper. Due to preferential affinity of molten waxes towards high surface energy paper, a part of the solid phase one is untangled from the ink matrix and transports with it enough ink to register images on paper.

In one important embodiment of the present invention, there are selected as the specific ink formulation for single strike ink donor films about 11 percent by weight of carbon black Regal 99®, about 5 percent by weight of a dispersing component, about 27 percent by weight of natural beeswax, about 51 percent by weight of paraffin wax, about 1 percent by weight of carnauba wax, about 1 percent by weight polyethylene wax, and about 4 percent by weight of poly(vinylmethyl ether).

Other specific ink formulations selected for a single strike ink donor film is comprised of 11 percent by weight of carbon black Regal® 400, 5 percent by weight of the dispersing agent WB14, and a wax blend comprised of 8 percent by weight of modified polyethylene wax (Vybar 103), 7 percent by weight of unmodified polyethylene wax (Epolene C-10), 25 percent by weight of ester wax, and 40 percent by weight paraffin wax; and 4 percent by weight of poly(vinylmethyl ether).

Examples of ink donor film substrates that can be selected for the ink donor films of the present invention include Mylar, commercially available from E.I. DuPont; Melinex, commercially available from Imperial Chemical, Incorporated; Celanar, commercially available from Celanese; polycarbonates, especially Lexan; polysulfones; cellulose triacetates; polyvinyl chlorides; and the like, with Mylars being particularly preferred primarily because of their availability and lower costs. The substrate such as Mylar which is present in a thickness of from about 12 microns to about 22 microns is usually precoated with, for example, poly(vinyl alcohol) on the back of the ink donor film substrate, thus when the heating heads utilized contact the film they do not stick to the back of the donor Mylar film. This coating is present in a thickness of from about 1 to about 2 microns, and is affected from a 10 percent by weight solution of poly(vinyl alcohol) in water on a Keegan coater. Sticking of Mylar to the heating heads is also overcome by using aluminized Mylar where the side facing the heating heads is pretreated with aluminum. When aluminized Mylar is selected for preparing the ink donor films of the present invention, the thermal transfer of waxes is greatly enhanced due to improved thermal contact between the heating heads and aluminum coating. Aluminization of Mylar (optical density of 1, 2 or 3) was accomplished at Cellplast, Incorporated by vacuum deposition. Various degrees of aluminum deposit were made and tested.

Illustrative examples of wax blends selected for the ink formulations of the present invention include hydrocarbon waxes, such as ester waxes, paraffin waxes, carnauba waxes, and polyethylene waxes. Specific examples of wax blends are (1) from about 25 percent by weight to about 35 percent by weight of natural beeswax (Koster Keunen, Inc.), from about 45 percent by weight to about 60 percent by weight of paraffin wax (Paraffin 1246, International Waxes, Ltd.), from about 1 percent by weight to about 5 percent by weight of carnauba wax (Carnauba Yellow 1, Koster Keunen, Inc.), and from about 1 percent by weight to about 3 percent by weight of modified polyethylene wax (Vybar 103, Petrolite Corporation); and (2) from about 35 percent by weight to about 50 percent by weight of Paraffin 1246, from about 25 percent by weight to about 35 percent by weight of synthetic ester wax (Montan, Hoechst), from about 7 percent by weight to about 10 percent by weight of modified polyethylene wax Vybar 103, and from about 7 percent by weight to about 10 percent by weight of unmodified polyethylene wax (Epolene C-10, AC 400 Eastman).

Examples of oil soluble dyes that may be selected for the ink formulations illustrated herein include Sudan Red 460, Sudan Blue 670, Sudan Yellow 150 and Sudan Black X-60, available from BASF Chemical. These dyes are usually present in an amount of from about 1 to about 3 percent by weight of the ink formulation.

Examples of pigment particles that may be selected for the ink formulations are carbon black (Regal ®99, Regal® 400, supplied by Cabot Carbon), magenta (Fanal Pink 4830), yellow (Pigment Yellow 108, Pigment Yellow 12, Pigment Yellow 95), and cyan (Pigment Blue 154, Pigment Blue 1, Pigment Blue 9). These pigments account for about 10 to about 15 percent by weight of the ink formulations, which formulations when coated on a substrate such as Mylar or aluminized Mylar, with the other components indicated herein yield ink donor films bearing black, yellow, magenta and cyan colors. The aforementioned resulting color ribbons typically have four consecutive segments of black, magenta, cyan and yellow where each segment is 15 inches long and 11 inches wide. The printer mechanism registers the dots so that they can be selectively overlapped to produce seven colors and black. Printers that employ dithering technique can create many more shades. Also, the pigments selected for the ink donor films of the present invention allow superimposition, thereby enabling various transparent colors. Therefore, the resulting ink donor films can be selected in preparing transparencies for overhead projections.

Another important ingredient of the ink formulations illustrated herein include dispersing agents, especially for the pigments; however, they can also be selected for the oil soluble dye particles. Illustrative examples of dispersants present in an effective amount of from, for example, about 1 to about 10 percent by weight include Petrolite WB (Petrolite Corporation), and the like. The WB dispersing agents are predominantly urethane modified oxygenated waxes designed to disperse pigments in nonvolatile oil systems without thixotropy. Petrolite WB14 was selected since it readily dispersed most pigments thus permitting low viscosity inks. Other pigment dispersing agents that can be selected are WB11, WB17 and GANEX V216.

Specific examples of binder polymers utilized for the ink donor films are styrene/ethylacrylate/butylacrylate copolymers wherein styrene is present in an amount of 50 percent by weight, ethylacrylate is present in an amount of 25 percent by weight, and butylacrylate is present in an amount of 25 percent by weight; blends of 50 percent by weight of the diblock copolymer styrene-b-dimethylsiloxane (styrene=60 percent by weight with molecular weight, $Mn=1.0\times10^4$ to $1.0\times10^5$, dimethylsiloxane, 40 percent by weight with $Mn=1.0\times10^4$ to $1.0\times10^5$) with styrene-b-isoprene (styrene=40 percent by weight with $Mn=1.0\times10^4$ to $1.0\times10^5$, isoprene 60 percent by weight with $Mn=1.0\times10^4$ to $1.0\times10^5$), a block copolymer of styrene-b-isoprene-b-dimethylsiloxane (styrene content 50 percent by weight, isoprene content 40 percent by weight, and dimethylsiloxane content 10 percent by weight) triblock copolymer.

When formulating a hot melt ink for thermal transfer printing processes, the ink should possess a viscosity of from 50 to 100 centipoises at the printing temperature, a melting point of between about 65° to about 75° C., and a blocking temperature greater than about 55 ° C. In addition, the ink viscosity should not change with time (non-thixotropic), and no transfer of ink under pressure should occur. The inks illustrated herein with a blend of four waxes is selected for accomplishing these and other objectives. More specifically, the paraffin wax, such as 1246, constitutes more than 40 percent by weight of the ink composition and acts as a dispersing medium for the pigments, and controls the viscosity and melting range of the ink. Natural beeswax, synthetic ester wax and modified polyethylene wax are characterized by their extreme plasticity, tackiness and tensile strength. Unmodified polyethylene wax is used for optimizing hardness, blocking point, tensile and adhesion. Carnauba wax is selected for viscosity and melting point control. Although paraffin and ester waxes constitute more than 50 percent by weight of the ink formulation, proportions of other waxes in the blend depend on the choice of substrate used for the ink donor film as well as the intended use of the ink donor film, that is whether it is for a single or multistrike application.

With respect to the preparation of the inks, generally the ink formulations for single strike ink donor films are dispersed in an attritor for about 1 to 3 hours. A typical attritor consists of a cylindrical jacketed grinding tank fitted with vertical, rotating shaft. The lower portion of the shaft is equipped with metal prongs which provide the actual movement of a ball/mill base mixture. When the shaft rotates, the metal prongs sweep through the tank providing the continuous movement of steel balls which, in turn, provide shear and impact required for effective dispersion. The tank is jacketed to maintain the inside temperature at 90°±5° C. As a grinding medium, steel balls diameter ¼ inch are used. The degree of dispersion is assessed with a heated NPIRI gauge (depth from 25 to 0 microns). This depth corresponds to 6-8 calibration of the Hegman gauge. The degree of dispersion is determined as a function of the dwell time within the attritor.

The standard procedure that can be utilized for dispersing carbon black and/or other pigments in hydrocarbon waxes is accomplished, for example, in the following manner. To Paraffin 1246, ester wax and Petrolite WB14 premelted in the jacketed attritor set at 90°±5° C., Regal® 99 carbon black was added and mixed slowly (50 rpm) to break all the lumps and provide their thorough wetting for about 10 minutes. At this stage the speed of the mixer was increased to 300 rpm. The dispersions were monitored every hour with the heated NPIRI gauge. After three hours, dispersions were achieved (reading of 6+ on the Hegman scale); thereafter the balance of the materials polyethylene wax, carnauba wax and the binder were added and mixed for 30 minutes at 90°±5° C. These dispersions were strained through 50 micron filters and stored in special containers for coatings on a Rotary Coater using direct gravure method. Gravure application is best suited for coatings up to 10 grams/meter square, although heavier coating weights can be achieved. The amount of the coating to be applied to the substrate is a determining factor in the choice of the gravure roll. The most common cell patterns engraved on the roll are trihelicoid, pyramid and quadrangular, pyramid being the preferred pattern for the present invention.

During the coating process, the donor substrate Mylar passes through a nip formed between the driven gravure roll and an elastomer covered backing (impression) roll. The driven gravure roll rotates in a pan which contains coating material. A steel doctor blade is positioned against the gravure roll, immediately before the nip. The backing (impression) roll is a rubber covered steel cylinder, and its only purpose is to press the web onto the engraved roll and create a vacuum high enough to withdraw the coating from the engraved cells. During the coating process at 150° C., the donor substrate Mylar speed averaged 25–30 feet per minute, and the coating thickness varied from 2–8 microns. Gravure rolls with 150, 165, and 200 lines per inch gave coatings with average thicknesses of 8 microns, 5 microns and 2 microns, respectively; preferred thickness being 4 microns for a single strike ink donor film.

One of the ink formulations designed for multistrike use is comprised of paraffin wax, 40 percent by weight, Montan ester wax 30 percent by weight, unmodified polyethylene wax (C-10), 9 percent by weight, modified polyethylene wax (Vybar 103), 9 percent by weight, dye, 2 percent by weight, and styrene/ethylacrylate/-butylacrylate copolymer, 10 percent by weight. This dispersion diluted to 30 percent solids in toluene was coated on 22 microns thick aluminized Mylar with known reverse roll techniques. The thickness of multistrike ink donor film coating can be varied from between about 10 to about 20 microns with 12 microns being preferred. Other multistrike ink donor films can be prepared by changing the binder material from copolymers of styrene/ethylacrylate/butylacrylate to blends of 50 percent by weight of a styrene-b-dimethylsiloxane diblock copolymer, and 50 percent by weight of a styrene-b-isoprene diblock copolymer; or to a styrene-b-isoprene-b-dimethylsiloxane triblock copolymer. Coatings of these solutions onto Mylar were accomplished by reverse roll as well as solvent extrusion techniques, thereby permitting coating thicknesses of from about 10 to about 20 microns to be achieved.

In reverse roll coating, the premetered ink material is transferred from the applicator roll to the donor, for example a Mylar substrate moving in the opposite direction. Metering is performed in the gap precision-ground stainless steel rolls. The metering roll is stationary or is rotating slowly in the opposite direction of the applicator roll, also referred to as the transfer roll. The latter, which is supported by a soft-backing roll and wipes the coating from the applicator roll as it passes, rotates with a surface speed one-half to two times the speed of the Mylar.

Slot extrusion coating utilizes a flat die to apply coating materials with the die lips in close proximity to the supporting substrate, such as Mylar. The precise premetering capabilities of a positive displacement pump can be used even though the coating material does not form a film. Once the desired amount of coating has been applied to the web, the coating is dried at 50°–70° C. in an air dryer.

These ink donor films of the present invention were tested in the Diablo EPM thermal transfer printer which is equipped with a data input-interface, a printhead, a transfer ribbon, a mechanism to coordinate the combination of head, paper and ribbon motion, and a properly specified output material. The data from the input interface is fed to the thermal head which makes contact with the back of the ribbon substrate and melts the inks. The melted inks are then transferred on to the receptor surface which is either paper or transparent Mylar for overhead projections, and images are formed.

The transfer ribbon of the Diablo EPM® printer was replaced with ink donor films of the present invention, and images were formed on Xerox 4024 paper in a fashion described above.

Compatibility and non-compatibility of waxes and polymers was established as follows: 1.0 gram of paraffin wax, 2.0 grams of Vybar 103, 2.0 grams of unmodified polyethylene wax AC-400, and 3.0 grams of ester wax were melt blended at 85° C. in a beaker on a hot plate equipped with a magnetic stirring device. Subsequently, 4.0 grams of poly(ethylacrylate) dissolved in 20 milliliters of toluene were added and stirred in the wax blend. This blend of waxes and polymer was then hand coated at 85° C. on to Mylar using a Meyer rod. The thickness of the coated blend was between 10 and 15 microns, and the coating was transparent indicating that poly(ethylacrylate) was compatible with the waxes. Similar results were obtained on replacing poly(ethylacrylate) with poly(butylacrylate), poly(isoprene), poly(dimethylsiloxane) and poly(vinylmethyl ether). However, when poly(ethylacrylate) was replaced with poly(styrene), the final coating of waxes and poly(styrene) were opaque indicating that poly(styrene) was not compatible with the waxes.

The optical density measurements of these images were affected on Pacific Spectrograph Color System. The system consists of two major components, an optical sensor and a data terminal. The optical sensor employs a 6 inch integrating sphere to provide diffuse illumination and 8 degrees viewing. This sensor can be used to measure both transmission and reflectance samples. When reflectance samples are measured, a specular component may be included. A high resolution, full dispersion, grating monochromator was used to scan the spectrum from 380 to 720 nanometers. The data terminal features a 12 inch CRT display, numerical keyboard for selection of operating parameters, and the entry of tristimulus values; and an alphanumeric keyboard for entry of product standard information.

The pigmented single strike ink donor films of the present invention, reference Examples I and II, yielded images on 4024 paper with optical density values of 1.0(black), 1.2(magenta), 0.80(yellow), and 1.6 (cyan). Images obtained with the Okimate 20® printer fitted with Okimate ink donor film, on the other hand, had optical density values of 1.5(black), 0.90(magenta), 0.66(yellow), and 1.14(cyan). The black of Okimate 20® is made up of triple pass (cyan, magenta and yellow) and is not a single color black as is the case of the invention of the present application.

Images obtained with dyed multistrike ink donor films of the present invention, reference the Examples that follow, had average optical density values of 1.6(black), 1.4(cyan), 1.4 (magenta), and 0.7(yellow) for the first print. Subsequent 6 prints had optical density values which were within ±0.2 of 1.2(black), 1.0(cyan), 1.0(magenta), and 0.5(yellow).

The following examples are being submitted to further define the present invention, it being noted that these Examples are intended to illustrate and not limit the scope of the present invention. Parts and percentages are by weight unless otherwise indicated.

EXAMPLE I

There was prepared a black single strike ink donor film by coating on to Mylar a carbon black based ink dispersion which was blended as follows: 5 grams of the dispersing agent WB14, 25 grams of Montan wax and 40 grams of paraffin wax were melted together; 11 grams of Regal® 400 where then stirred in manually, and thereafter the materials were loaded into an attritor at 85° to 95° C. The degree of dispersion was determined by Hegman gauge (scratches only below 5 microns line or 7½ Hegman). After dispersion was completed, 8 grams of Vybar 103, 7 grams of polyethylene wax (Epolene C-10), and 3 grams of poly(vinylmethyl ether) were added to the mill base, and the resulting materials were stirred for ½ hour at 85 to 95° C. This dispersion was strained through 50 micron filters and applied on to a 10 microns thick Mylar (bearing a back coating of poly(vinyl alcohol) in a thickness of 2 microns) via direct gravure method on a Rotary Coater. The thickness of the ink donor layer as measured by a micrometer was 5 microns. This ink donor film was then tested in a Diablo EPM® thermal transfer printer, and there resulted images on Xerox Corporation 4024 paper with an optical density 1.20.

EXAMPLE II

Single strike magenta, cyan and yellow ink donor films were prepared in a manner similar to that described in Example I with the exception that in place of carbon black the colored pigments magenta (Fanal Pink 4830), 10 percent by weight, cyan (Pigment Blue 9), 10 percent by weight, and yellow (Pigment Yellow 12), 12 percent by weight, were selected. These ink donor films when tested with a Diablo EPM® thermal transfer printer yielded images on 4024 paper with optical density values of 1.2(magenta), 0.8(yellow), and 1.6(cyan).

EXAMPLE III

Multistrike cyan ink donor film was prepared by coating onto aluminized Mylar (22 microns thick) a cyan dispersion prepared in the following manner: 40 grams of Paraffin 1246, 30 grams of Montan ester wax, 9 grams of unmodified polyethylene wax (C-10), and 9 grams of modified polyethylene wax (Vybar 103) were melted together. Thereafter, 2 grams of dye, Sudan Blue 670, was added in toluene to the melt along with 10 grams of styrene/ethylacrylate/butylacrylate copolymer. The composition of styrene in the copolymer was 50 percent by weight, whereas ethylacrylate and butylacrylate were present in an amount 25 percent by weight each. The coating of this dispersion on Mylar was affected on a Keegan coater using reverse roll technique. Coating thickness of the prepared ink on Mylar was measured at 12 microns (coating weight 12 grams per meter squared), and the ink layer had a melting point of about 75° C. This ink donor film was substituted in the Diablo EPM® printer, and images were obtained by rewinding the ink donor film after each print cycle and positioning the ink film in such a way that the area addressed by the printhead remained constant. Optical density values of images obtained in the first 7 cycles were within ±0.2 of 1.0.

EXAMPLE IV

Multistrike magenta color ink donor film was prepared by coating onto aluminized Mylar (22 microns thick), a magenta dispersion prepared in the following manner: 40 grams of Paraffin 1246, 30 grams of montan ester wax, 9 grams of unmodified polyethylene wax (C-10), and 9 grams of modified polyethylene wax (Vybar 103) were melted together. Thereafter, 2 grams of dye, Sudan Red 460, was added in toluene to the melt along with 10 grams of a styrene-b-isoprene-b-dimethylsiloxane triblock copolymer comprised of 50 percent by weight of styrene, 40 percent by weight of isoprene, and 10 percent by weight of dimethylsiloxane. The total weight of toluene in the dispersion was 235 grams thus yielding a dispersion at 30 percent solids. The coating of this dispersion on Mylar was affected on a Keegan coater using reverse roll technique. Coating thickness of the formulated ink on Mylar was measured at 12 microns. This ink donor film yielded 7 images of optical density within ±0.2 of 1.0 when tested in a Diablo EPM® thermal transfer printer.

Other modifications of the present invention may occur to those skilled in the art as a result of a review of the disclosure of the present application, and these modifications are intended to be included within the scope of the present invention.

What is claimed is:

1. A thermal transfer ink donor film comprised of a supporting substrate with a coating of an ink composition on the top surface thereof, which ink is comprised of a blend of four hydrocarbon waxes, pigment particles, pigment dispersants, and binder polymers selected from the group consisting of (1) styrene-b-isoprene-b-dimethyl siloxane triblock copolymers; (2) blends of styrene-b-isoprene diblock copolymers with styrene-b-dimethylsiloxane diblock copolymers; (3) styrene/ethylacrylate/butylacrylate random copolymers; and (4) poly(vinylmethyl ether).

2. A thermal transfer ink donor film in accordance with claim 1 wherein there are selected oil soluble dyes as the pigment particles.

3. An ink donor film in accordance with claim 2 wherein the oil soluble dyes are selected from the group consisting of black, cyan, magenta, yellow, and mixtures thereof.

4. An ink donor film in accordance with claim 3 wherein from about 1.0 percent by weight to about 3.0 percent by weight of the oil soluble dye is present.

5. A thermal transfer ink donor film in accordance with claim 1 wherein the waxes are comprised of a mixture of ester waxes, paraffin waxes, carnauba waxes, and polyethylene waxes.

6. An ink donor film in accordance with claim 1 wherein the blend of waxes is comprised of from about 25 percent by weight to about 35 percent by weight of natural ester beeswax, from about 45 percent by weight to about 60 percent by weight of a paraffin wax, from about 1 percent by weight to about 5 percent by weight of a carnauba wax, and from about 1 percent by weight to about 3 percent by weight of a modified polyethylene wax (Vybar 103).

7. An ink donor film in accordance with claim 1 wherein the blend of waxes is comprised of from about 35 percent by weight to about 50 percent by weight of a paraffin wax, from about 25 percent by weight to about 35 percent by weight of a montan ester wax, from about 7 percent by weight to about 10 percent by weight of a modified polyethylene wax, and from about 7 percent by weight to about 10 percent by weight of an unmodified polyethylene wax.

8. An ink donor film in accordance with claim 1 wherein the dispersant is present in an amount of from about 4 percent by weight to about 5 percent by weight, and is comprised of a urethane modified wax.

9. An ink donor film in accordance with claim 1 wherein the pigment particles are selected from the group consisting of black, magenta, cyan and yellow, and mixtures thereof.

10. An ink donor film in accordance with claim 9 wherein from about 8 percent by weight to about 12 percent by weight of carbon black pigment, from about 6 percent by weight to about 10 percent by weight of cyan, from about 6 percent by weight to about 10 percent by weight of magenta, and from about 6 percent by weight to about 12 percent by weight of yellow pigment are present.

11. An ink donor film in accordance with claim 1 wherein from about 3 percent by weight to about 30 percent by weight of the binder polymer is present.

12. An ink donor film in accordance with claim 1 wherein the the binder copolymer is poly(vinylmethyl ether).

13. A thermal transfer ink donor film in accordance with claim 1 wherein the styrene/ethylacrylate/butylacrylate polymer contains styrene in an amount of from about 30 percent by weight to about 60 percent by weight, ethylacrylate in an amount of from about 35 percent by weight to about 20 percent by weight, and butylacrylate in an amount of from about 35 percent by weight to about 20 percent by weight.

14. A thermal transfer ink donor film in accordance with claim 1 wherein the supporting substrate is comprised of poly(ethylene terephthalate).

15. A thermal transfer ink donor film in accordance with claim 14 wherein the thickness of the substrate is from about 6 to about 22 microns.

16. A thermal transfer ink donor film in accordance with claim 1 wherein the thickness of the ink formulation present on the supporting substrate for single strike ink donor films is from about 3 to about 6 microns.

17. A thermal transfer ink donor film in accordance with claim 1 wherein the thickness of the ink formulation present on the supporting substrate for multistrike ink donor films is from about 10 microns to about 20 microns.

18. An ink donor film for thermal transfer printing processes, comprising a supporting substrate with a coating of an ink composition on the top surface thereof, which ink comprises a blend of four hydrocarbon waxes, pigment particles, pigment dispersants, and binder polymers selected from the group consisting of (1) styrene-b-isoprene-b-dimethyl siloxane triblock copolymers; (2) blends of styrene-b-isoprene diblock copolymers with styrene-b-dimethyl siloxane diblock copolymers; (3) styrene/ethylacrylate/butylacrylate random copolymers; and (4) poly(vinylmethyl ether), wherein the supporting substate contains a coating of poly(vinyl alcohol) or aluminum on the bottom surface thereof.

19. An ink donor film for thermal transfer printing processes, comprising a supporting substrate with a coating of an ink composition on the top surface thereof, which ink comprises a blend of four hydrocarbon waxes, pigment particles, pigment dispersants, and binder polymers comprised of (1) styrene-b-isoprene, and (2) styrene-b-dimethyl siloxane with from about 35 percent by weight to about 65 percent by weight of copolymer (1) and from about 65 percent by weight to about 35 percent by weight of copolymer (2).

20. An ink donor film for thermal transfer printing processes, comprising a supporting substrate with a coating of an ink composition on the top surface thereof, which ink comprises a blend of four hydrocarbon waxes, pigment particles, pigment dispersants, and binder polymers comprised of a styrene-b-isoprene-b-dimethyl siloxane triblock copolymer with from about 30 percent by weight to about 60 percent by weight of styrene, from about 50 percent by weight to about 30 percent by weight of isoprene, and from about 20 percent by weight to about 10 percent by weight of dimethyl siloxane.

21. An ink donor film in accordance with claim 20 wherein there are selected water soluble dyes as the pigment particles.

22. An ink donor film in accordance with claim 20 wherein the supporting substrate contains a coating of polyvinyl alcohol or aluminum on the bottom surface thereof.

23. An ink donor film in accordance with claim 20 wherein the waxes are comprised of a mixture of ester waxes, paraffin waxes, carnauba waxes and polyethylene waxes.

24. An ink fonor film in accordance with claim 20 wherein the blend of waxes is comprised of from about 25 percent by weight to about 35 percent by weight of natural ester beeswax, from about 45 percent by weight to about 60 percent by weight of a paraffin wax, from about 1 percent by weight to about 5 percent by weight of a carnauba wax, and from about 1 percent by weight to about 3 percent by weight of a modified polyethylene wax.

25. An ink donor film for thermal transfer printing processes, comprising a supporting substrate with a coating of an ink composition on the top surface thereof, which ink comprises a blend of four hydrocarbon waxes, pigment particles, pigment dispersants, and binder polymers selected from the group consisting of (1) styrene-b-isoprene-b-dimethyl siloxane triblock copolymers; (2) blends of styrene-b-isoprene diblock copolymers with styrene-b-dimethyl siloxane diblock copolymers; (3) styrene/ethylacrylate/butylacrylate random copolymers; and (4) poly(vinylmethyl ether), wherein the supporting substrate contains on the bottom surface thereof a release coating of poly(vinyl alcohol) in a thickness of from about 1 to about 2 microns.

26. An ink donor film for thermal transfer printing processes, comprising a supporting substrate with a coating of an ink composition on the top surface thereof, which ink comprises a blend of four hydrocarbon waxes, pigment particles, pigment dispersants, and binder polymers selected from the group consisting of (1) styrene-b-isoprene-b-dimethyl siloxane triblock copolymers; (2) blends of styrene-b-isoprene diblock copolymers with styrene-b-dimethyl siloxane diblock copolymers; (3) styrene/ethylacrylate/butylacrylate random copolymers; and (4) poly(vinylmethyl ether), wherein the supporting substrate contains on the bottom surface a coating of aluminum in a thickness of from about 30 to about 80 Angstroms.

* * * * *